US010278436B2

(12) United States Patent
Paquette

(10) Patent No.: US 10,278,436 B2
(45) Date of Patent: May 7, 2019

(54) PROTECTIVE GEAR

(71) Applicant: Warrior Sports, Inc., Warren, MI (US)

(72) Inventor: Adam D. Paquette, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 344 days.

(21) Appl. No.: 15/366,234

(22) Filed: Dec. 1, 2016

(65) Prior Publication Data

US 2018/0153233 A1 Jun. 7, 2018

(51) Int. Cl.

| | |
|---|---|
| ***A41D 13/08*** | (2006.01) |
| ***A63B 71/12*** | (2006.01) |
| ***A41D 13/06*** | (2006.01) |
| ***A41D 13/05*** | (2006.01) |
| ***A41D 13/015*** | (2006.01) |

(52) U.S. Cl.

CPC ..... *A41D 13/08* (2013.01); *A41D 13/0153* (2013.01); *A41D 13/0568* (2013.01); *A41D 13/065* (2013.01); *A63B 71/1225* (2013.01); *A63B 2071/125* (2013.01); *A63B 2071/1258* (2013.01); *A63B 2071/1275* (2013.01)

(58) Field of Classification Search

CPC ..... A41D 13/08; A41D 13/0153; A41D 13/0568; A41D 13/065; A63B 71/1225

USPC ..... 2/16

See application file for complete search history.

(56) References Cited

U.S. PATENT DOCUMENTS

| | | | | |
|---|---|---|---|---|
| 4,694,505 | A | 9/1987 | Flosi et al. | |
| 4,884,561 | A | 12/1989 | Letson, Sr. | |
| 5,358,471 | A | 10/1994 | Klotz | |
| 5,611,080 | A * | 3/1997 | Skottheim | A41D 13/0568 2/16 |
| 6,058,504 | A | 5/2000 | Tollini | |
| 6,108,814 | A | 8/2000 | Tollini | |
| 6,205,583 | B1 | 3/2001 | Beland | |
| 7,188,370 | B2 * | 3/2007 | Bevier | A63B 71/1225 2/22 |
| 7,743,429 | B2 * | 6/2010 | Bevier | A63B 71/1225 2/22 |
| 8,108,951 | B2 | 2/2012 | Gabry et al. | |
| 8,555,426 | B2 | 10/2013 | Kamradt | |
| 2002/0184693 | A1 | 12/2002 | Beland | |
| 2004/0181850 | A1 | 9/2004 | Beland | |
| 2007/0234460 | A1 | 10/2007 | Castonguay et al. | |

(Continued)

FOREIGN PATENT DOCUMENTS

| | | |
|---|---|---|
| CA | 2316634 | 3/2001 |

*Primary Examiner* — Gloria M Hale

(74) *Attorney, Agent, or Firm* — Warner Norcross + Judd, LLP

(57) ABSTRACT

Protective gear for protecting an arm or other body part of a wearer, such as a lacrosse, hockey, baseball, or other sports player, or an occupational worker, is provided. The gear can be in the form of an arm guard including a forearm guard, a biceps guard and a sleeve. The sleeve can be joined with the forearm guard and an upper end of the biceps guard, with a lower end of the biceps guard being free from attachment to the sleeve to facilitate radioulnar rotation of the forearm guard and thus the forearm of the wearer. The arm guard can include a low profile elbow cap that is integral with the forearm guard, and generally free floating within and joined with the forearm guard, rather than being a separate component from the forearm guard.

20 Claims, 8 Drawing Sheets

(56) References Cited

U.S. PATENT DOCUMENTS

| | | | | |
|---|---|---|---|---|
| 2010/0223708 | A1 | 9/2010 | Salmini | |
| 2013/0312152 | A1 | 11/2013 | Paul et al. | |
| 2015/0264987 | A1* | 9/2015 | Morin ..... | A41D 13/08 2/16 |

* cited by examiner

PROTECTIVE GEAR

BACKGROUND OF THE INVENTION

The present invention relates to protective gear, and more particularly to an arm guard.

Protective gear is used to protect its wearer from injury or from experiencing an impact due to applied forces. The popularity of physical sports has increased the need for personal protective padding. Sporting activities, such as hockey, lacrosse, baseball, basketball, football, soccer, biking, motorcycling and occupational activities all can lead to falls, collisions and impacts, which can cause pain, injury and damage to unprotected parts of a person's body. Protective gear can be worn to counter these effects. For example, in the field of lacrosse, players use lacrosse sticks to pass and shoot a lacrosse ball at significant speeds. Lacrosse players also are subject to checking, which can be somewhat violent, and can involve impacts to various body parts. Further, many times, lacrosse players are subject to blows from the lacrosse sticks of opponents. Accordingly, lacrosse players typically wear protective gear.

One type of protective gear is the arm guard. Typically, an arm guard for lacrosse play includes three parts: a forearm pad, a biceps pad and an elbow pad disposed between and connecting the biceps pad and the forearm pad. The biceps pad and the forearm pad are sewn to one another or the elbow pad at their ends adjacent the elbow of a wearer. While this closes the area at the elbow joint that otherwise might be exposed along the wearer's arm, it can be uncomfortable and can impede motion of the wearer's arm, and in particular, radioulnar rotation. The three generally, rigidly attached arm pads of a typical lacrosse arm guard also can impair the flexion of the arm at the elbow joint.

In most lacrosse arm guards, the elbow pad is placed exterior relative to the biceps pad. In turn, this creates a small projecting ledge at the upper edge of the elbow pad along the wearer's arm. Thus, when an opponent engages the wearer with a downward stroked lacrosse stick, the stick engages the ledge and elbow pad, and can tug the arm pad down the wearer's arm. This can impart more of the force from the blow to the wearer's arm as it is translated to the ledge and elbow pad.

Accordingly, there remains room for improvement in the field of protective gear, particularly with regard to arm guards and similar appendage protective devices.

SUMMARY OF THE INVENTION

Protective gear for an appendage of a wearer is provided. In one embodiment, the protective gear can be in the form of an arm guard including a forearm guard, a biceps guard and a sleeve. The sleeve can be joined with the forearm guard and an upper end of the biceps guard, with a lower end of the biceps guard being free from extensive attachment to the sleeve to facilitate radioulnar rotation of the forearm guard, and thus the forearm of the wearer.

In another embodiment, the arm guard can include a low profile elbow cap that is integral with the forearm guard. The elbow cap can be generally free floating relative to and joined with the forearm guard, rather than being a completely separate component from the forearm guard.

In a further embodiment, the forearm guard can include an upper end, and the biceps guard can include a lower end. The biceps guard lower end can be free from attachment to an upper end of the forearm guard, optionally except for at least one elastic strap. In some cases, the edges of the respective upper end and lower end can be joined via one or more elastic straps, with a remainder of those ends and their edges being free from attachment to any other components to facilitate freedom of movement, and rotation of the forearm guard relative to the biceps guard.

In another embodiment, the upper end of the forearm guard can be joined with an elastic strap that extends upwardly to a location disposed on an interior of the biceps guard, where the other end of the strap is joined with that biceps guard. This location can be distal from an upper end and a lower end of the biceps guard.

In still another embodiment, the forearm guard can include an exterior forearm pad and an interior forearm pad, optionally spaced from one another. The exterior forearm pad can include a first perimeter and the interior forearm pad can include a second perimeter. The first perimeter can be joined with the second perimeter, and the exterior forearm pad can be substantially free from attachment to the interior forearm pad, inward from the second perimeter.

In even another embodiment, the arm guard can include an elbow cap. The exterior forearm pad can define an elbow cap hole. The elbow cap can be joined with and suspended by a portion of the forearm guard. The elbow cap can be moveable toward and away from the elbow pad hole, in some cases selectively projecting at least partially through the elbow cap hole.

In yet another embodiment, the arm guard can be constructed so that a lower end of the biceps guard overlaps and conceals an upper end of the forearm guard. With this overlapped part of the forearm guard, the biceps guard can deflect vertical blows away from the forearm guard.

The current embodiments of the protective gear provide impact and bodily injury protection that has been unachievable with previous arm guards. For example, where the elbow cap is suspended in the forearm guard, it has a low profile yet excellent impact protection and force dissipation for the elbow. Where the forearm pad and biceps pad are connected via the sleeve and free from attachment with that sleeve at their respective ends, the forearm pad is free to promote radioulnar rotation and enhance mobility of the forearm and hand relative to the upper arm. This freedom can be helpful where the arm guard wearer is manipulating a stick. Where the lower end of the biceps guard overlaps the forearm guard above the elbow, the biceps guard can efficiently deflect vertical blows away from the forearm guard.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
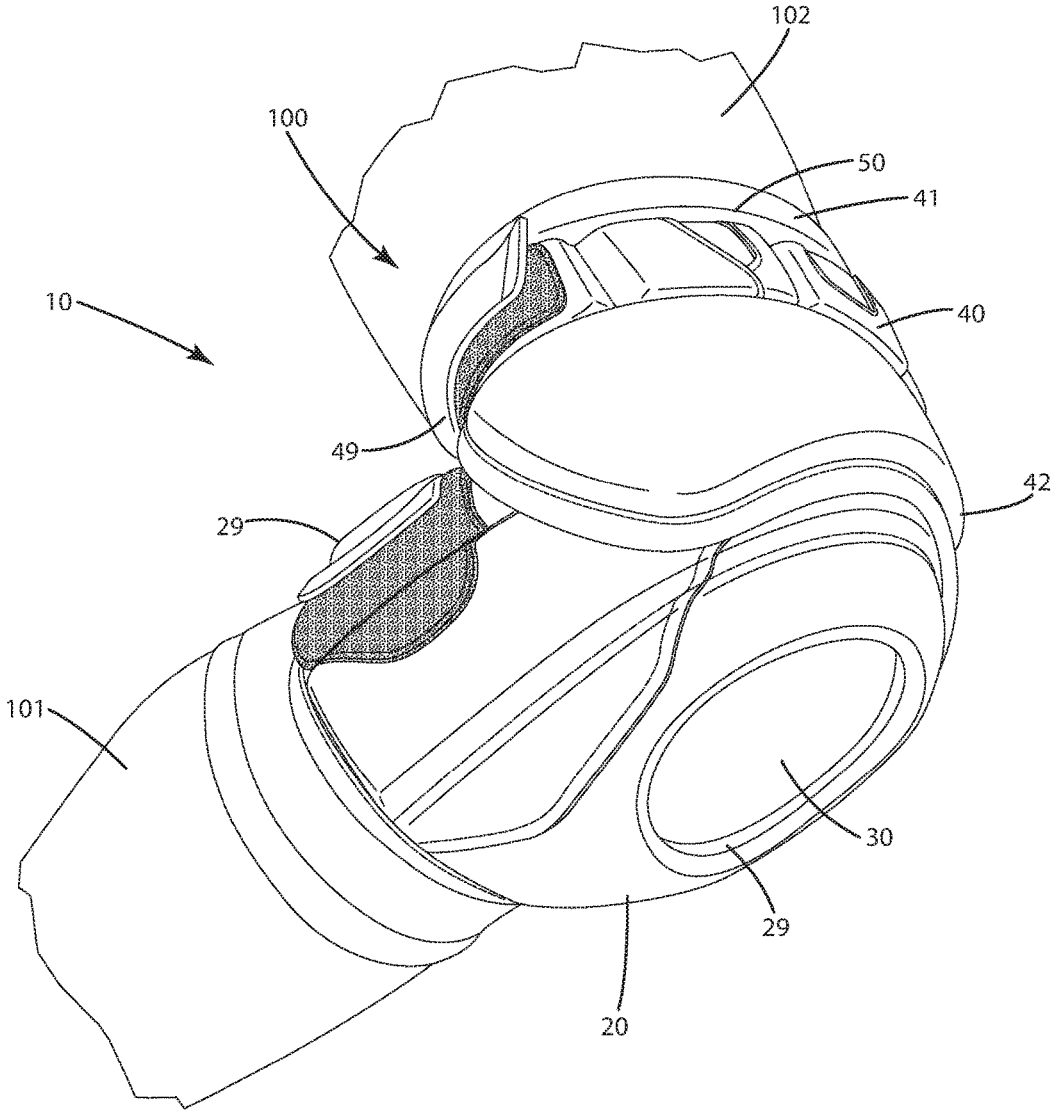
FIG. 1 is a perspective view of the arm guard of a current embodiment on a wearer's arm.
Figure 2:
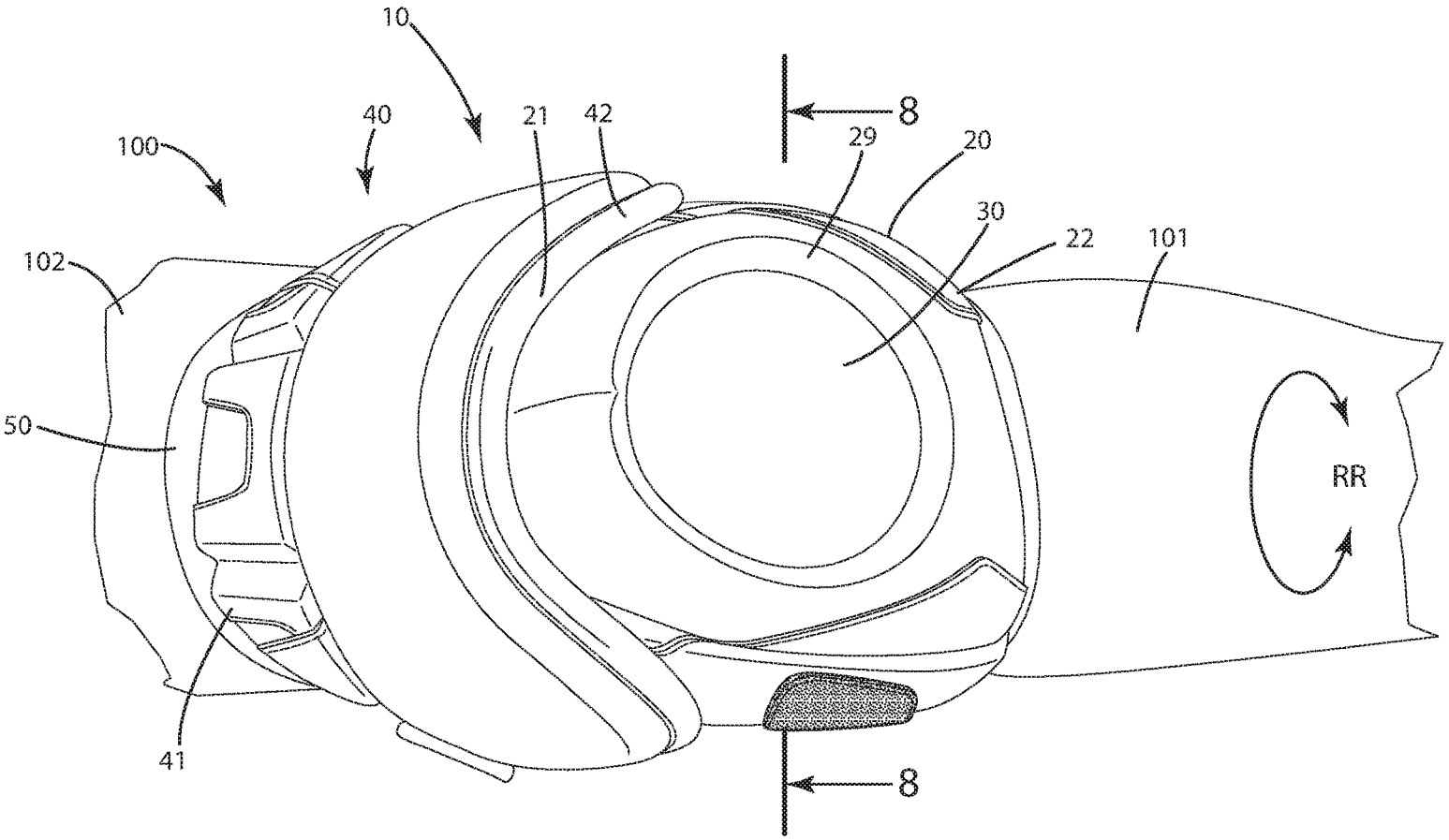
FIG. 2 is another perspective view of the arm guard illustrating radioulnar rotation with the arm guard in place.

A current embodiment of the protective gear in the form of an arm guard is illustrated in FIGS. 1-11 and generally designated 10. The protective gear or arm guard 10 can be configured to extend over and adjacent the anterior, medial, lateral and posterior portions of an arm 100 of a wearer in use. The arm guard generally can include a forearm guard 20, an elbow cap 30 and a biceps guard 40. The forearm guard can engage a forearm 101 of a wearer, and can define an exterior pad elbow hole 29. The elbow cap 30 can extend into and can be free floating relative to the exterior pad elbow hole 39, and other portions of the forearm guard as explained below. A sleeve 50 can be joined with the forearm guard, for placement immediately adjacent the wearer. The sleeve can effectively hold the forearm guard in proximity to the wearer's forearm 101, and can hold the biceps guard in proximity to the wearer's upper arm 102, generally preventing the arm guard from moving relating to the wearer's arm.

Although described in conjunction with an arm guard, the protective gear herein can be incorporated into knee pads, shin guards, wrist guards, gloves, leg pads, ankle pads, body armor, and a variety of other protective equipment. Further, although described in connection with protective gear for sports, the protective gear herein can be used in occupational, law enforcement, military and other applications.

The various components of the arm guard will now be described in further detail. With reference to FIGS. 2 and 4-8, the forearm guard 20 can be constructed so that the elbow cap 30 is integral with and/or housed at least partially within the guard, rather than being a third and separate guard attached to the forearm guard and the biceps guard. In general, the forearm guard is configured to engage the forearm 101 of the wearer. The forearm guard 20 can include an upper or first end 21 and a lower end 22. The upper end 21 can be higher up the forearm 101 of the wearer than the lower end 22. Each of the upper end and lower end can be of a concave configuration so as to enable the forearm of the wearer to fit within the forearm guard. With this construction, the forearm guard and its components also extend upwardly on the medial and lateral sides of the wearer's forearm to provide protection thereto.

Figure 4:
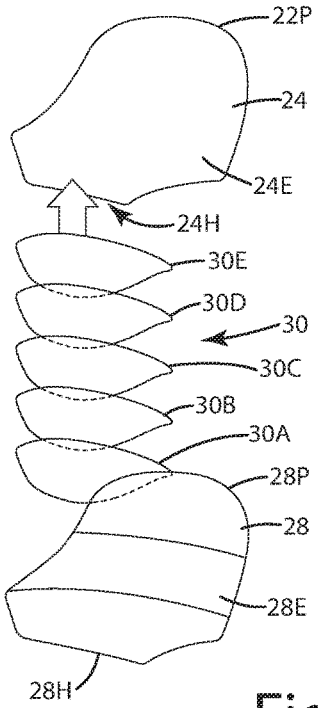
FIG. 4 is an exploded view of the forearm guard, including an exterior forearm pad, an interior forearm pad and an elbow cap.
Figure 5:
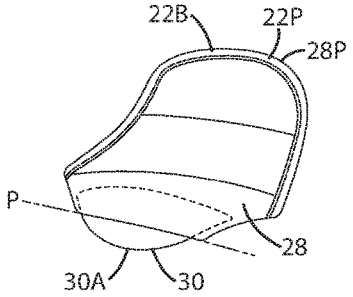
FIG. 5 is a side view of the forearm guard after assembly.

The forearm guard 20 can be constructed to include multiple layers. The configuration of these layers can provide suspension to the elbow cap within the forearm guard. As shown in the exploded view of FIG. 4, the forearm guard 20 can include an interior forearm pad 24 and exterior forearm pad 28. The interior forearm pad 24 can be configured to be closer to the forearm 101 of the wearer when the arm guard is donned. The exterior forearm pad 28 can form an exterior of the forearm guard, and can be positioned farther from the forearm of the wearer than the interior forearm pad 24. Each of the interior forearm pad 24 and the exterior forearm pad 28 can be contiguous with one another. Each can also include perimeters. For example, as shown in FIG. 4, the interior forearm pad can include an outer interior forearm pad perimeter 22P. The exterior forearm pad 28 can include an outer exterior forearm pad perimeter 28P. These outer interior forearm pad perimeter and outer exterior forearm pad perimeters can be joined with one another via a binding 22B as shown in FIG. 5. This binding can be sewn, glued, fastened or otherwise attached to the respective perimeters. Alternatively, the binding can be absent and the perimeters can be stitched, fastened, glued or otherwise joined with one another. Generally, with this construction the perimeters primarily are the only structures of the interior forearm pad and exterior forearm pad that are joined with one another. Thus, the remainder of the interior forearm pad 24, located interior to the perimeter 22P thereof, can be unjoined and unattached, or generally free from attachment to the remainder of the exterior forearm pad inward from the outer interior forearm pad perimeter 28P. Likewise, the exterior forearm pad 28 is free from attachment to the interior forearm pad 24, inward from the outer exterior forearm pad perimeter. Of course, in some cases small, insignificant straps, stitches and/or strands can join the interior forearm pad and the exterior forearm pad inward from the perimeters, but the interior forearm pad and an exterior forearm pad are still considered to be free from attachment. With this construction, the interior forearm pad is effectively suspended interiorly relative to the exterior forearm pad. As illustrated with reference to FIG. 8, the interior forearm pad 24 is disposed inward relative to the exterior forearm pad 28. Between the outer surface 240 of the interior forearm pad, and the interior surface 281 of the exterior forearm pad, a gap G1 is formed. This gap can be variable depending on movement of the interior and exterior forearm pads relative to one another and other conditions. For example, near the binding 22B, the gap is indicated as G3. That gap G3 is smaller than the gap G1 located distal from the binding. In some cases of course, the gap can be constant between the respective interior forearm pad and the exterior forearm pad and their respective surfaces.

Figure 6:
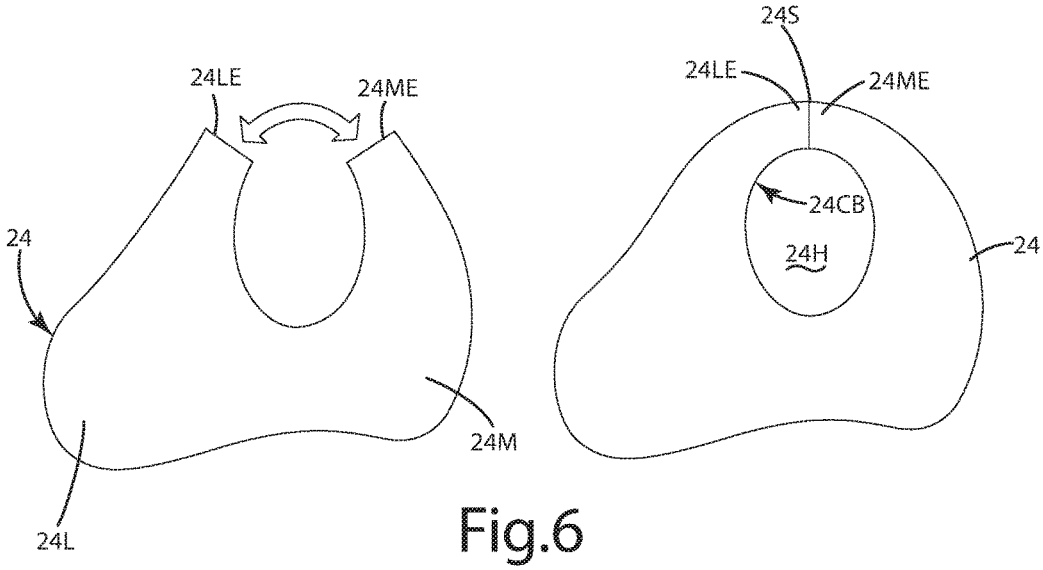
FIG. 6 is a plan view showing assembly of the interior forearm pad of the arm guard.

Optionally, the interior forearm pad can be in the form of a unitary, single piece, monolithic layer of EVA foam. Of course, this pad can be constructed from other types of foams, gels, thermoplastic materials and the like. As shown in FIG. 6, the interior pad 24 can be constructed to include a lateral pad portion 24L and a medial pad portion 24M.

These portions can respectively include a first pad edge 24LE in the form of a lateral edge. The pad also can include a second pad edge, in the form of a medial edge 24ME. The pad 24 can be initially formed in a flat configuration shown to the left of FIG. 6. When the edges before 24LE and 24ME are joined along a seam 24S as shown to the right in FIG. 6, the lateral 24L and medial 24M portions tend to take on a three-dimensional shape, furling the remainder of the interior forearm pad into the configuration shown in FIG. 7. Further, when these edges are joined, the interior forearm pad effectively forms an interior forearm pad elbow hole 24H. This interior forearm pad elbow hole is configured to be aligned with an exterior pad elbow hole 28H which is defined by the exterior forearm pad 28 as further described below. This interior elbow pad hole 24H can be closed via the elbow cap 30. Optionally, the elbow cap 30 can cover substantially all of the interior elbow pad hole.

Figure 7:
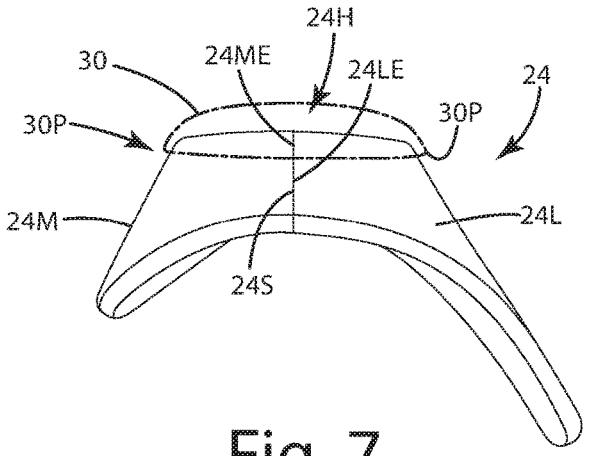
FIG. 7 is a front view of the interior forearm pad after assembly of the same.
Figure 8:
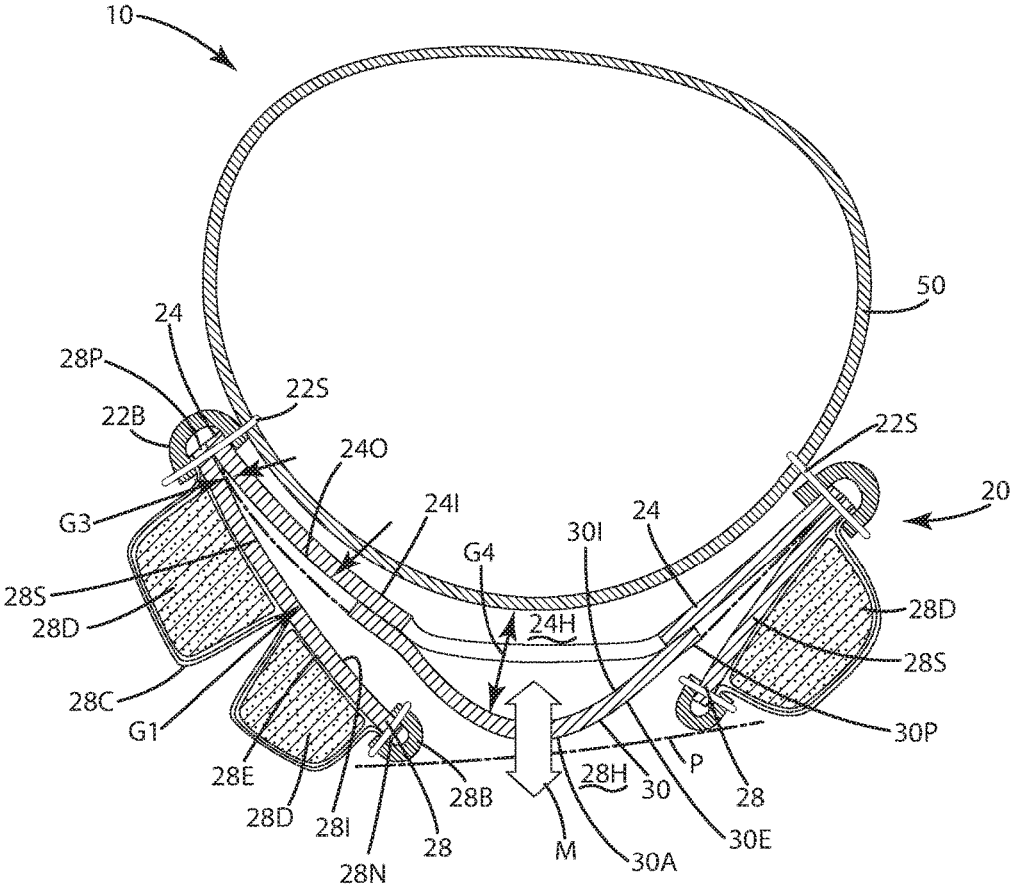
FIG. 8 is a section view of the forearm guard illustrating the suspension of the elbow cap with the interior forearm pad inside the exterior forearm pad, taken along lines 8-8 of FIG. 2.

As shown in FIGS. 7 and 8, the elbow cap 30 can include a Perimeter 30P. This perimeter 30P can extend about and can form the outer boundary of the elbow cap. This perimeter 30P can be joined with the interior forearm pad 24, and in particular, the outermost boundary or edge 2418 of the interior forearm pad that is adjacent the interior pad elbow hole 24H. This perimeter can be joined via stitching, sewing, gluing, cementing and/or fasteners. With this attachment, the interior pad elbow hole 24H remains open so that a user's elbow can project at least partially through it and into a portion of the elbow 30, as described further below. Optionally, the elbow and its perimeter 30P can extend over the seam 24S formed between the edges 24ME and 24LE of the interior forearm pad 24.

As shown in FIG. 8, the exterior forearm pad can include multiple individual padding elements 28D that are movably joined to one another. For example, these padding elements can be in the form of foam pads or other cushioning material that can flex and move slightly relative to one another depending on the movement of the wearer and/or an impact. These padding elements 28D can be joined with the support layer 28S of the exterior forearm pad 28. The support layer can be a substrate such as foam, thermoplastic or other materials, can have varying thicknesses and intensities depending on the application. If desired, a cover 28C can be attached and otherwise overlay the padding elements 28D and the support layer 28S, at least on the exterior surface 28E of the exterior pad 28. This cover can be constructed from a material that is a fabric, knitted, woven or non-woven, such as Lycra™, Spandex™, vinyl, polyester, nylon, leather, faux leather, or some other generally soft, pliable, lightweight and optionally breathable material.

Optionally, as shown in FIG. 8, the exterior forearm pad 28 can include an outer perimeter 28P attached via a binding 22B to the interior forearm guard pad 24. The exterior pad 28 can include another binding 28B that covers the support pad or layer 28S and the cover 28C of the pad. In some cases, the binding can be in the form of a portion of the cover 28C that wraps beyond an edge 28N that is adjacent an exterior pad elbow hole 28H.

Figure 10:
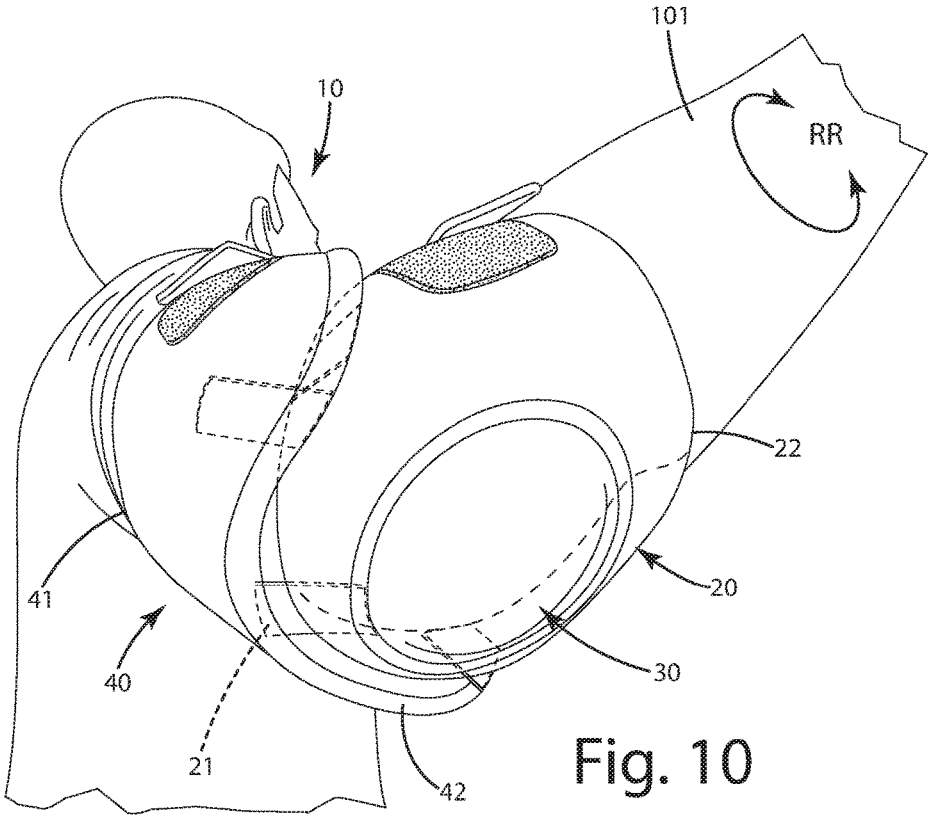
FIG. 10 is a rear perspective view of the arm guard illustrating movement of the forearm guard relative to the biceps guard to facilitate radioulnar rotation of the forearm of the wearer.

The exterior forearm pad 28 can be formed from a flat planar construction initially, and then upon sewing together of edges, can form a three-dimensional shape as shown in FIGS. 4, 8 and 10. Generally, the construction of the exterior forearm pad can be similar to that of the interior forearm pad. For example with reference to FIG. 6, the exterior forearm guard pad can be formed from a flat planar piece similar to that of the interior pad 24. Subsequently, edges similar to edges 24LE and 24ME can be joined or closed to form the three-dimensional configuration of the exterior elbow pad, along with the exterior pad elbow hole 28H.

Referring to FIG. 8, the elbow cap 30 is joined with the interior forearm pad 24. Due to this attachment, the elbow cap 30 can be generally suspended at least partially within the gap G1 defined between the interior pad 24 and the exterior pad 28. The elbow pad 30 also can be suspended and project at least partially through and/or into the exterior pad elbow hole 28H. Due to the suspension, the elbow cap can be movably disposed relative to the exterior elbow pad. For example, the elbow cap 30 can be movable toward and away from, or into or through the exterior pad elbow hole 28H. As a more particular example, the elbow cap 30 can move in direction M so that more or less of the elbow cap projects into and/or through the exterior pad elbow hole 28H. Where the elbow cap includes an apex 30A, that apex can project into and/or through the exterior pad elbow hole 28H to certain degrees. For example, when the arm guard 10 simply being worn by the user and not absorbing impact, the apex 30A can be disposed inward from the plane P defined by the edge 28 and around the exterior pad elbow hole 28H. When the user's elbow engages the interior pad 24, the elbow cap 30 moves with it. The apex can extend to, beyond and/or through the plane P, depending on the severity of the impact. It will be appreciated, however, that the elbow cap and its apex can in some cases extend through the plane P even when the forearm guard is not absorbing an impact. In most cases, the elbow cap and apex are visible to a viewer of the arm guard when the arm guard is in use and properly installed on the wearer.

Optionally, the elbow cap 30 can be suspended by the interior pad 24 so that when the arm guard is not being impacted, the elbow cap 30 does not engage the interior surface 281 of the exterior pad 28. However, upon impact the elbow cap 30 can move in the direction M outward. In so doing, the exterior surface 30E of the elbow cap can engage the interior surface 281 of the exterior pad 28. Upon removal of the impact force, the elbow 30 can retract upward so that the exterior 30E of the elbow cap moves away from and no longer engages the interior 281 of the exterior pad 28.

As shown in FIG. 4, the elbow cap 30 can include multiple layers. For example, the elbow cap can be constructed to include layers 30A-30E. These layers can include a polyurethane panel 30A, EVA foam panels 30B and 30D, optionally of different densities and thicknesses, a rigid shell 30C constructed from a thermoplastic, composite, metal or other hard material, an interior liner 30E constructed, for example, from a polyester, nylon or other soft material fabric. Of course, the elbow can include more or fewer layers. Further optionally, the elbow cap can include only the relatively hard rigid shell to protect the elbow of the wearer.

The elbow cap 30 can, as mentioned above, include an exterior 30E and an interior 30I. The exterior 30E can be of a convex, partially-rounded shape. The interior likewise can be a corresponding concave, disc like shape to receive an elbow of a wearer. The various layers and components of the elbow can be correspondingly shaped to provide contours configured to accommodate the elbow of the wearer.

With reference to FIGS. 1, 3, 8 and 11, and as mentioned above, the arm guard 10 can include a sleeve 50. The sleeve optionally can be a tubular configuration as best shown in FIG. 8 to accommodate the arm of a wearer. This sleeve, in the form of a tube, can extend along both the forearm guard and the biceps guard, and can be configured to assist in retaining the arm guard 10 on the wearer's arm. In some cases, the sleeve can be all that is used to achieve this attachment. In other cases, optional straps can be used to assist the sleeve in retaining the arm guard 10 on the arm of a wearer. In other cases, the sleeve can be absent and the straps can be the only thing holding the arm guard on the arm of a wearer.

Where straps are included, they optionally can be in the form of a biceps guard strap 49 and a forearm guard strap 29. The straps can be constructed from an elastic material. Strap ends 49E, 29E can be fixedly secured to the respective biceps guard and forearm guard. The opposing ends 49F, 29F of the straps can include fasteners, for example hook and loop fasteners, to secure those respective ends to the opposing side of the respective biceps guard and forearm guard, thereby securing the wearer's arm therein. In some cases, these elastic straps can be fixedly attached at both ends to opposing sides of the respective biceps guard and forearm guard.

Figure 11:
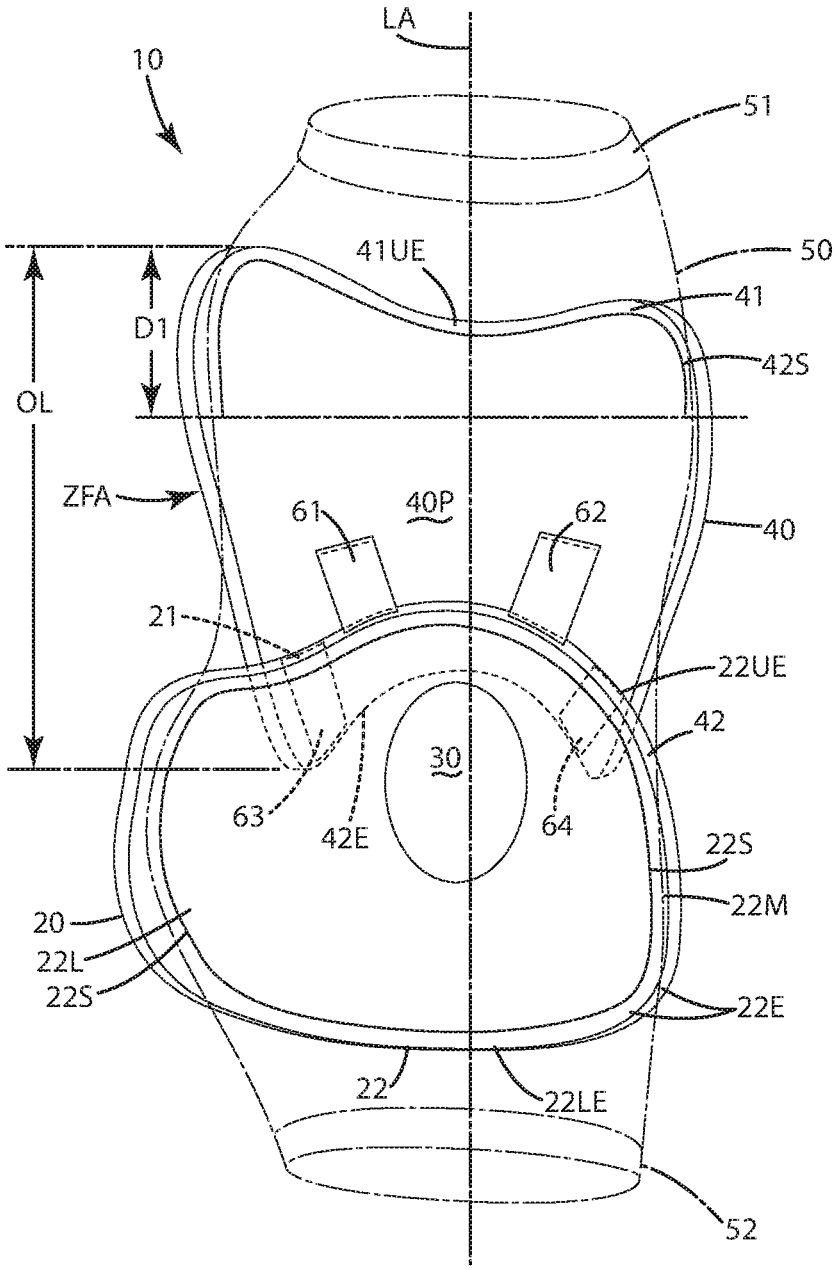
FIG. 11 is a front interior view of a sleeve and its selective attachment to the biceps guard and the forearm guard to facilitate radioulnar rotation of the forearm of the wearer.

Returning to the configuration of the sleeve, it can be constructed from a fabric, knitted, woven or non-woven, such as Lycra™, Spandex™, vinyl, polyester, nylon or some other generally soft, pliable, lightweight, and optionally breathable material. The sleeve can be glued, stitched, cemented or otherwise secured with fasteners to various selected portions of the arm guard to provide acceptable functionality. With regard to its attachment to the forearm guard, as shown in FIGS. 8 and 11, the sleeve can be sewn and/or stitched with stitching 22S around a majority of the outer edges 22E of the forearm of guard 20. For example, the sleeve can be stitched with stitching 22S to the lower edge 22LE of the forearm guard, adjacent the lower end 22 of the forearm guard. The sleeve also can be stitched along the side edges 22M and 22L extending rearward or upward from the lower edge 22LE. The sleeve also can be stitched along the upper edge 22UE with stitching 22S adjacent the upper end 21 of the forearm guard 20. Optionally, the stitching 22S that attaches the sleeve to the forearm guard can be the stitching that attaches binding 22B to the respective pads of the forearm guard. Of course in other cases, the sleeve can be attached to fewer selected edges, in any combination, of the forearm guard. In other cases, and even further optionally, the sleeve can be glued, adhered, stitched down or fastened using fasteners to various portions of the forearm guard. In some cases, for example, shown in FIG. 8, the sleeve 50 can be located inward relative to the interior pad 24 and the exterior pad 28. Further, a gap G4 can be established between the elbow cap 30 and the sleeve 50.

Referring to FIG. 11, the sleeve 50 can include an upper end 51 and a lower end 52. Optionally, the upper end 51 can project above the uppermost edge and/or end 31 of the bicep guard 30. The sleeve lower end 52 can project below the lower end 22 of the forearm guard. In certain applications, the sleeve ends may or may not extend beyond the respective arm guards. Further, as mentioned above, the sleeve in some cases can be deleted altogether, with the arm guard being held on the wearer's arm by selectively placed straps.

The arm guard 10 can include a biceps guard 40 disposed generally above the forearm guard 20 when the arm guard is on the wearer. The biceps guard 40 can include an upper end 41 and a lower end 42. The upper end 41 can be closer to the shoulder of a wearer than the lower end. The lower end 42 can be configured to at least partially overlap the upper end 21 of the forearm guard. This configuration is illustrated in FIGS. 2, 3, 10 and 11. There, the lower end 42 of the biceps guard 40 includes a lower edge 42E. This lower edge 42E extends outward and overlaps over an exterior surface of the forearm guard 20. This lower edge 42E can extend beyond the upper edge 22UE of the forearm guard so that, that upper edge 22UE is concealed and located under the biceps guard. Optionally, the entire lower edge 42E of the lower end 42 can be located lower along the wearer's arm 100 than the upper edge 22UE of the forearm guard 20. In most cases, the lower edge 42E can be of an arcuate configuration and configured to wrap around at least a portion of the wearer's arm, optionally above the elbow. With this overlapping construction, it has been discovered that the arm guard 10 of the current embodiment surprisingly is well-suited to divert vertical blows that initially engage the biceps guard 40. Due to the overlap, the impacting object, for example, a lacrosse stick, rides down and slides along the outer surface of the biceps guard. Because of the overlap of the lower end and edge of the biceps guard over the upper edge of the forearm guard, the impacting object simply rides off the end of the overhang and downward. It does not engage the upper edge 22UE or upper end 21 of the forearm guard. Accordingly, this prevents the impacting object from engaging that lip or edge of the forearm guard and pulling the arm guard down or otherwise displacing it on the wearer's arm. In turn, this keeps the arm guard in place in its protective capacity.

Figure 3:
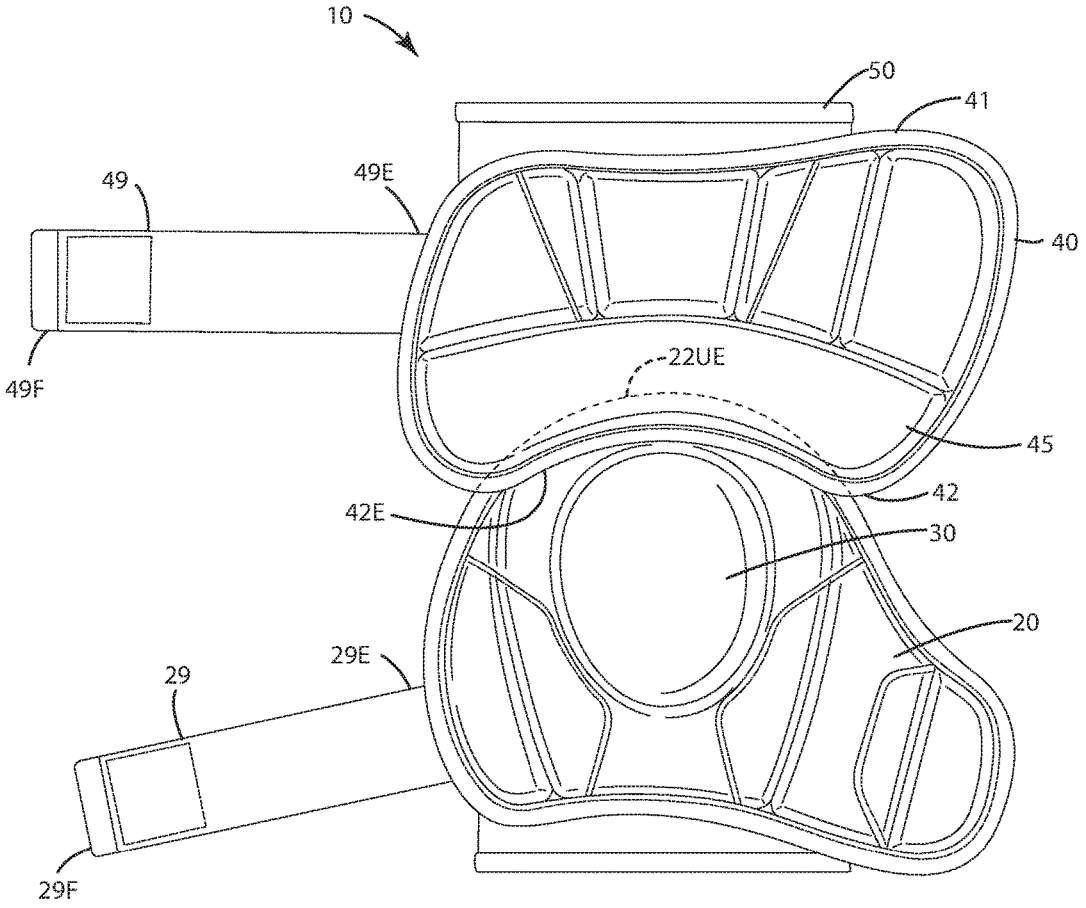
FIG. 3 is a rear exterior view of the arm guard.
Figure 9:
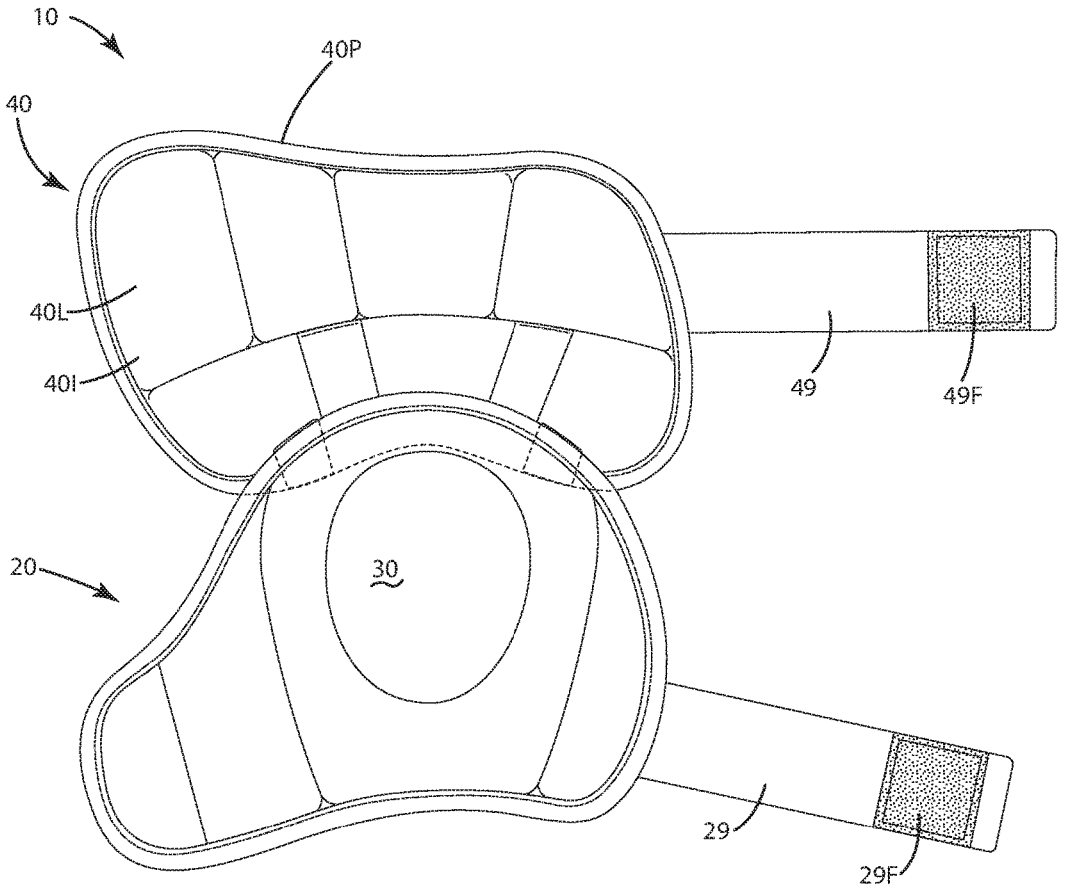
FIG. 9 is a front interior view of the arm guard illustrating the attachment of the forearm guard with the biceps guard utilizing straps.

The biceps guard 40 shown in FIGS. 3 and 9 can be constructed from multiple padding elements, similar to the forearm guard below. The biceps guard 40 can include a cover layer or inner liner 40L on the interior 401 of the biceps guard. The outermost perimeter of the biceps guard 40P can include a binding that secures various padding elements and a cover and/or lining to one another. Optionally, the biceps guard 40 can include a biceps cap 45 joined adjacent the lower end 42 of the biceps guard 40. This bicep cap can be the form of a rigid shell. The rigid shell can be constructed from thermoplastic rigid material, composite, metal or other similar rigid material. If desired, it can be covered with a cover material. This bicep cap 45 of the biceps guard 40 can enhance protection and dissipate blows to the elbow of the wearer and/or upper arm of the wearer.

The biceps guard 40 and forearm guard 20 can be directly joined with one another via one or more components. For example as shown in FIG. 11, the biceps guard 40 can be attached to the sleeve 50 via a stitching 42S. The stitching can extend primarily adjacent the upper end 41 of the biceps 40. For example, it can extend along the upper edge 41UE and downward along the side edges 42S for a preselected distance D1. This distance D1 can be less than the overall length OL of the biceps guard. Optionally, this distance can be less than half the overall length; further optionally, less than one third; even further optionally, less than one quarter of the overall length OL of the biceps 40. The lower end 42, and more particularly, the lower edge 42E is substantially free from attachment to this sleeve 50 to facilitate radioulnar rotation of the forearm of the wearer and the forearm guard disposed thereon.

In this configuration, the sleeve can be attached to the biceps guard form 40 primarily along the upper end, with the lower end 42 of the biceps being unattached to the sleeve. In turn, this can create a zone free from attachment ZFA between the biceps guard and the sleeve. In this zone's ZFA, the sleeve is substantially free from attachment to the biceps guard 40. Thus, the sleeve is free to move relative to the biceps guard in this zone's ZFA. What this provides is a freedom of movement of the forearm guard 20 relative to the biceps guard 40. The sleeve 50, in that zone's ZFA is thus free to rotate and slide relative to the interior 401 of the bicep guard. In turn, this enables the forearm guard 20 to move more freely relative to that biceps guard 40. As shown in FIG. 10, this enables the forearm guard 20 to remain secured to the forearm 101, and move with the forearm 101 as the forearm and arm in general undergo radioulnar rotation RR.

With this freedom of radioulnar rotation provided by the arm guard, a wearer can manipulate a stick or otherwise rotate their hand freely without much impairment to that movement caused by the arm guard 10.

Optionally, the forearm guard 20 can be joined with the biceps guard, via other components in addition to the sleeve 50. For example as shown in FIGS. 9-10, the arm guard can include one or more straps 61-64 that join various portions of the forearm guard 20 and the biceps guard 40. The straps optionally can be elastic, or otherwise able to stretch and return to original length. For example, the one or more first straps 63, 64 can extend between the upper end 22 in particular the upper edge 22UE of the forearm guard 20, to the lower end 42 of the biceps guard 40, and optionally, the lower edge 42E of the biceps guard. The ends of the straps may be sewn, stitched, glued and/or fastened to the respective ends of the guards, optionally to the bindings thereof. The first straps 63 and 64 can extend rearward from the upper edge 22UE attached directly to the lower edge 42E of the biceps guard 40. Straps 63 and 64 in this configuration can also extend outwardly, adjacent the exterior 28E of the forearm guard exterior pad 28. These straps can draw the lateral and medial portions of the lower end 42 of the biceps guards inward so they do not flare outward, to offer adequate protection in this region. Of course, in some cases, additional straps like these can be added to the construction, while in other applications, these straps can be deleted. Optionally, with straps that are deleted, the lower end 42 and/or lower edge 42E of the biceps guard is completely free from attachment to the upper edge 22UE and/or upper end 21 of the forearm guard. These straps also can be configured to minimize the impairment of radioulnar rotation of the wearer's forearm and the attached forearm guard.

The one or more second straps 61 and 62 can be joined with the upper edge 22UE and upper end 21 of the forearm guard 20 as well, or near that edge. These straps can extend upwardly, above the lower edge 42E and lower end 42 of the biceps guard 40. The straps can be joined with an interior portion 40P of the biceps guard 40. This interior portion can be disposed above the lower end 42 and below the upper end 41. Generally, this portion 40P, where the straps 61, 62 are attached can be in the zone free from attachment ZFA of the sleeve 50. Of course, in other cases, the straps 61, 62 can extend upwardly to the upper end 41 and attached to the interior portion 40P, outside the zone free from attachment ZFA of the sleeve 50. Further optionally, the other ends of the strap 61, 62 can be joined with the interior portion of the biceps between the upper end and the lower end, further optionally at a location about ⅓ to ½ the overall length of the pad upward from the lower edge 42EE. These straps can be located inward relative to the first straps 63 and 64. Due to their location inward and relatively close to the longitudinal axis LA of the arm guard 10, these straps do not significantly impair the radioulnar rotation of the forearm guard and forearm in general. Optionally, these straps 61, 62 also do not extend along the exterior 28E of the forearm guard pad. Instead, they extend upwardly and away from that exterior, and optionally do not overlap the other straps 63 and 64.

With the one or more elastic straps 61-64 in place, the biceps guard lower end 42 can be considered to be substantially free from attachment to the upper end 21 of the forearm guard, except for those straps. And again, in some cases, the straps can be deleted entirely in which case the biceps guard is entirely or completely free from attachment of its lower end to the upper end of the forearm guard. The straps 61-64 also can be constructed of a width so that the upper end edge 22UE of the upper end of the forearm guard and the lower end edge of the lower end of the biceps guard are free from attachment one another along a majority of the upper end edge and/or the lower end edge. Thus, these straps relative widths are less than half the overall length of that upper edge 22UE and/or lower edge 42E. With this minimal connection between the edges of the respective armed guards, biceps guard and forearm guard, the armguard can facilitate radioulnar rotation of the forearm of the wearer, and general movement of the forearm pad relative to the biceps pad.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The invention claimed is:

1. An arm guard comprising:

a forearm guard configured to engage a forearm of a wearer, the forearm guard including an upper end and a lower end, the upper end configured for placement on the wearer's forearm at a location that is at a top end of the wearer's forearm, and that is above a forearm location of the lower end, the forearm guard including an interior forearm pad and an exterior forearm pad, the interior forearm pad and the exterior forearm pad spaced from one another to form a forearm pad gap, the interior forearm pad configured to be closer to a skin surface of the forearm of the wearer, the exterior forearm pad configured to form an exterior of the forearm guard, the exterior forearm pad defining an exterior pad elbow hole;

an elbow cap including a rigid shell, the elbow cap being disposed between the interior forearm pad and the exterior forearm pad, the elbow cap being movable relative to the exterior pad elbow hole defined by the exterior forearm pad, the elbow cap including an elbow cap portion that projects at least partially through the exterior pad elbow hole of the exterior forearm pad, the elbow cap being joined with the interior forearm pad so that the elbow cap is configured to move with the interior forearm pad as the elbow cap moves relative to the exterior pad elbow hole;

a sleeve joined with the forearm guard, the sleeve being configured for placement closer to the skin surface of the wearer's forearm than the forearm guard, the sleeve being configured to hold the forearm guard in proximity to the wearer's forearm; and a biceps guard configured to engage an upper arm of the wearer, the biceps guard being located above the forearm guard, the biceps guard including an upper end and a lower end, the upper end of the biceps guard being attached to the sleeve, the lower end of the biceps guard being free from attachment to the sleeve to facilitate radioulnar rotation of the forearm of the wearer, the lower end of the biceps guard overlapping the upper end of the forearm guard whereby the biceps guard can deflect vertical blows away from the forearm guard.

2. The arm guard of claim 1, wherein the upper end of the forearm guard and the lower end of the biceps guard are free from attachment to one another to facilitate radioulnar rotation of the forearm of the wearer.

3. The arm guard of claim 1, wherein the upper end of the forearm guard includes an upper end edge and the lower end of the biceps guard includes a lower end edge, wherein the upper end edge and the lower end edge are free from attachment to one another along a majority of at least one of the upper end edge and the lower end edge to facilitate radioulnar rotation of the forearm of the wearer.

4. The arm guard of claim 3, comprising:

an arm guard longitudinal axis having a medial side and a lateral side opposing one another across the longitudinal axis, wherein the upper end edge and the lower end edge are attached via a first elastic strap on the lateral side and a second elastic strap on the medial side.

5. The arm guard of claim 1, wherein the elbow cap includes an apex that extends through the elbow pad hole defined by the exterior forearm pad, wherein the apex extends away from the forearm guard and is configured to form a contact portion when the arm guard engages an object.

6. The arm guard of claim 1, wherein the interior forearm pad defines an interior pad hole bounded by an inner perimeter, wherein the rigid shell includes an outer perimeter, wherein the outer perimeter is joined to the inner perimeter.

7. The arm guard of claim 1, wherein the interior forearm pad includes an outer interior forearm pad perimeter, wherein the exterior forearm pad includes an outer exterior forearm pad perimeter, wherein the outer interior forearm pad perimeter and the outer exterior forearm pad perimeter are affixed to one another so as to suspend the interior forearm pad interiorly relative to the exterior forearm pad.

8. The arm guard of claim 7, wherein the interior forearm pad is a unitary, single piece, monolithic layer of EVA foam, wherein the exterior forearm pad includes a plurality of individual padding elements movably joined to one another with a support layer.

9. The arm guard of claim 8, wherein the interior forearm pad includes a first pad edge and a second pad edge, the first pad edge and the second pad edge joined to one another to close and form an interior forearm pad elbow hole.

10. The arm guard of claim 1, wherein the interior forearm guard includes an interior surface and an exterior surface, and defines an interior forearm pad elbow hole, wherein the exterior pad elbow hole is aligned with the interior forearm pad elbow hole, wherein the elbow cap is disposed adjacent and engages the exterior surface of the interior forearm guard, wherein the elbow cap is aligned with the interior forearm pad elbow hole.

11. An arm guard comprising:

a forearm guard configured to engage a forearm of a wearer, the forearm guard defining an exterior pad elbow hole;

an elbow cap including a rigid shell, the elbow cap projecting into and being free floating relative to the exterior pad elbow hole;

a sleeve joined with the forearm guard, the sleeve being configured for placement closer to a skin surface of the wearer's forearm than the forearm guard and the elbow cap, the sleeve being configured to hold the forearm guard in proximity to the wearer's forearm; and a biceps guard configured to engage an upper arm of the wearer, the biceps guard being located vertically above the forearm guard and at least partially vertically above an elbow of the wearer, the biceps guard including an upper end and a lower end, the upper end of the biceps guard being attached to the sleeve, the lower end of the biceps guard being free from attachment to the sleeve to facilitate radioulnar rotation of the forearm of the wearer, wherein the lower end of the biceps guard overlaps and conceals an upper end of the forearm guard whereby the biceps guard can deflect vertical blows away from the forearm guard.

12. The arm guard of claim 11, wherein the forearm guard includes an exterior forearm pad having a first perimeter and an interior forearm pad having a second perimeter, the first perimeter joined with the second perimeter, the exterior forearm pad being free from attachment to the interior forearm pad inward from the second perimeter.

13. The arm guard of claim 12, wherein the elbow cap is joined with and suspended by the interior forearm pad, wherein the elbow cap is moveable toward and away from the exterior pad elbow hole.

14. The arm guard of claim 13, wherein the elbow cap includes an apex, wherein the apex projects through the exterior pad elbow hole and is configured to be visible to a viewer of the arm guard on the wearer.

15. The arm guard of claim 11, wherein the elbow cap projects at least partially through the exterior pad elbow hole and is configured to be visible to a viewer of the arm guard on the wearer.

16. The arm guard of claim 11, wherein the biceps guard lower end is free from attachment to an upper end of the forearm guard except for at least one elastic strap.

17. The arm guard of claim 11 comprising:

a first elastic strap extending between an upper end of the forearm guard and the lower end of the biceps guard, a second elastic strap extending between the upper end of the forearm guard and attached to an interior portion of the biceps guard, the interior portion being between the lower end of the biceps guard and the upper end of the biceps guard.

18. An arm guard comprising:

a forearm guard defining an elbow hole;

an elbow cap projecting into and being free floating relative to the elbow hole;

a biceps guard located vertically above the forearm guard and overlapping a bicep of the wearer and a portion of the forearm guard whereby vertical blows can be diverted by the biceps guard away from the forearm guard; and a sleeve joined with the forearm guard and an upper end of the biceps guard, a lower end of the biceps guard being substantially free from attachment to the sleeve to facilitate radioulnar rotation of the forearm of the wearer.

19. The arm guard of claim 18, wherein the biceps guard lower end is free from attachment to an upper end of the forearm guard except for at least one elastic strap.

20. The arm guard of claim 18, wherein the forearm guard includes an exterior forearm pad having a first perimeter and an interior forearm pad having a second perimeter, the first perimeter joined with the second perimeter, the exterior forearm pad being free from attachment to the interior forearm pad inward from the second perimeter, wherein the elbow cap is joined with and suspended by the interior forearm pad, wherein the elbow cap is moveable toward and away from the elbow hole.

* * * * *